US005244349A

United States Patent [19]

Wang

[11] Patent Number: 5,244,349

[45] Date of Patent: Sep. 14, 1993

[54] AIR FAN WITH LIGHTLY-CONSTRUCTED REINFORCING FAN BLADES

[76] Inventor: Sui-Mu Wang, c/o Hung Hsing Patent Service Center, P.O. Box 55-1670, Taipei (10477), Taiwan

[21] Appl. No.: 950,024

[22] Filed: Sep. 24, 1992

[51] Int. Cl.[5] ..... F04D 29/66; F04D 29/58

[52] U.S. Cl. ..... 416/231 R; 416/5; 416/95; 416/236 R; 415/119

[58] Field of Search ..... 416/5, 231 R, 235, 236 R, 416/95; 415/119

[56] References Cited

U.S. PATENT DOCUMENTS

D. 265,681 8/1982 Kan ..... 416/5
2,794,509 6/1957 Mix ..... 416/236 R
4,504,191 3/1985 Brown ..... 416/5
4,854,374 8/1989 Harrison ..... 416/95
5,154,570 10/1992 Yoshikawa et al. ..... 415/914

FOREIGN PATENT DOCUMENTS 164590 12/1980 Japan ..... 416/231 R
6468 of 1912 United Kingdom ..... 416/231
206880 11/1923 United Kingdom ..... 416/235

*Primary Examiner*—Edward K. Look
*Assistant Examiner*—Michael S. Lee

[57] ABSTRACT

An air fan includes a plurality of fan blades each fan blade drilled with a plurality of perforations in the fan blade for reducing weight of each fan blade for reducing the electric energy required for driving the fan motor of the air fan. Each fan blade may be reinforced by at least a rib on a surface of each fan blade for enhancing its strength and preventing its deformation.

3 Claims, 3 Drawing Sheets

AIR FAN WITH LIGHTLY-CONSTRUCTED REINFORCING FAN BLADES

BACKGROUND OF THE INVENTION

In an air-conditioned room, a ceiling fan may be provided for homogeneously circulating the cooling air in the room for helping making a comfortable air conditioning environment. A ceiling fan is generally comprised of a plurality of elongate fan blades which may increase a weight of the ceiling fan and require a big driving motor, thereby consuming higher electric energy.

It is therefore expected to disclose an air fan having fan blades made with lighter weight for saving electric energy.

SUMMARY OF THE INVENTION

The object of the present invention is to provide an air fan including a plurality of fan blades each fan blade drilled with a plurality of perforations in the fan blade for reducing weight of each fan blade for reducing the electric energy required for driving the fan motor of the air fan. Each fan blade may be reinforced by at least a rib on a surface of each fan blade for enhancing its strength and preventing its deformation.

DETAILED DESCRIPTION

Figure 1:
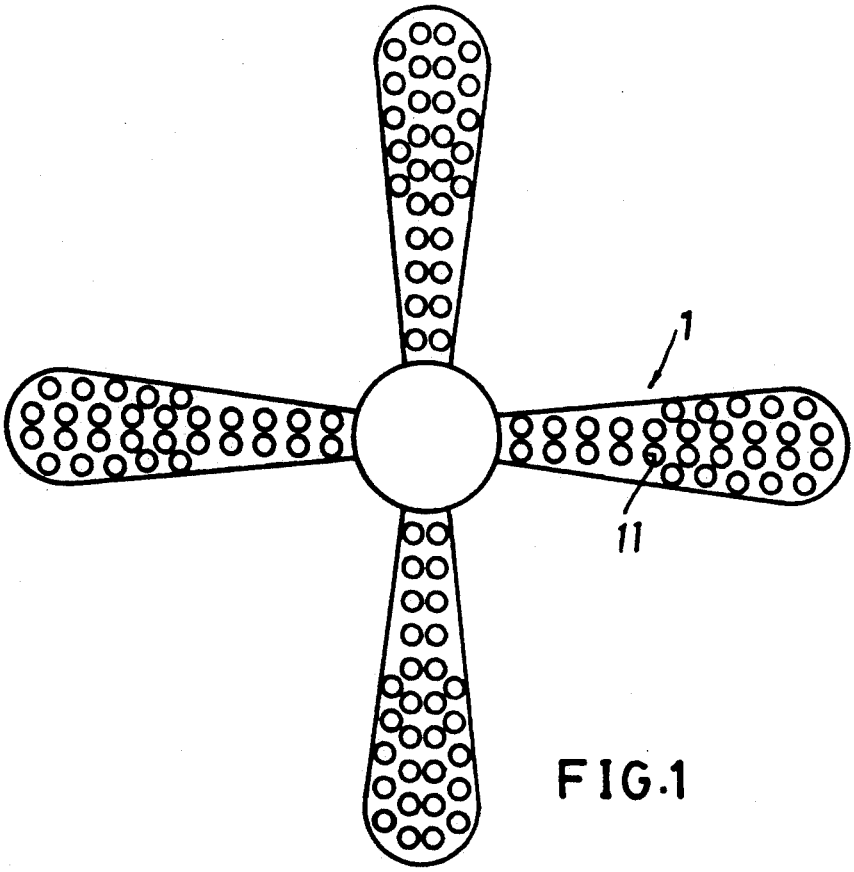
FIG. 1 is an illustration showing the present invention.
Figure 3:
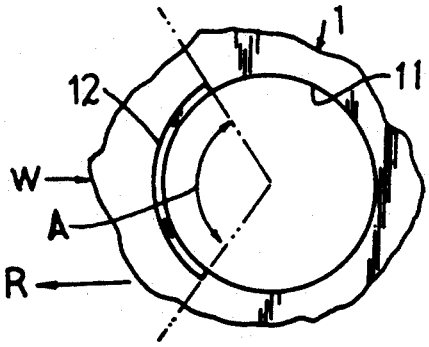
FIG. 3 is an illustration showing a noise-preventive extension formed on each fan blade of the present invention.
Figure 2:
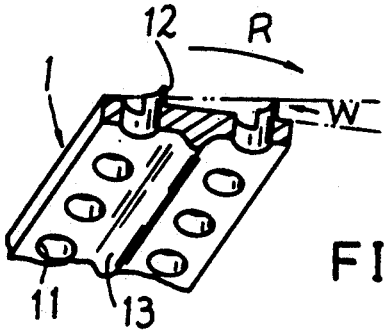
FIG. 2 is a partial illustration of a fan blade in accordance with the present invention.

As shown in FIGS. 1-4, an air fan of the present invention comprises: a plurality of fan blades 1 each fan blade 1 drilled or formed with a plurality of perforations 11 in the blade 1 for reducing its weight.

At least a rib 13 is formed on a surface of each fan blade 1 for reinforcing the strength of the blade for preventing its deformation.

A noise-preventive extension 12 is circumferentially formed on the fan blade 1 around a circumferential edge of each perforation 11 for obstructing or precluding an air stream flowing through each perforation 11 for preventing a whistling noise therefrom.

The noise-preventive extension 12 preferably occupies at least one third of a perimeter along a perforation circle of each perforation 11, i.e., at least defining a central angle of 120 degrees.

The noise-preventive extension 12 is provided on a windward side of each perforation 11 facing towards the incoming wind direction W when rotating the fan blade 1 in a direction R opposite to the incoming wind direction W.

The shapes, structure, arrangements, size and number of the extensions 12 and the perforations 11 of this invention are not limited.

Also, the rib 13 reinforced on the fan blade 1 is not limited for its shapes, number, orientations, height or width, etc.

The fan blade 1 is preferably made by plastic molding processes, but may also be made of other materials, which are not limited in this invention.

Figure 5:
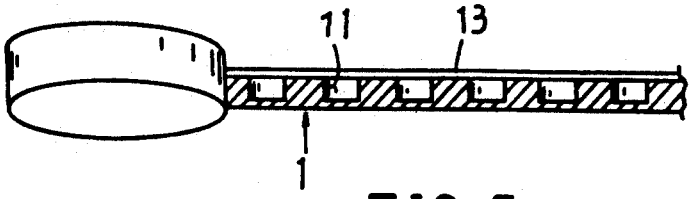
FIG. 5 is a partial sectional drawing of another preferred embodiment of the present invention.

As shown in FIG. 5, the perforation 11 may not be formed through the fan blade 1. It means that each perforation 11 is recessed in the blade 1 without passing through the blade 11.

Figure 6:
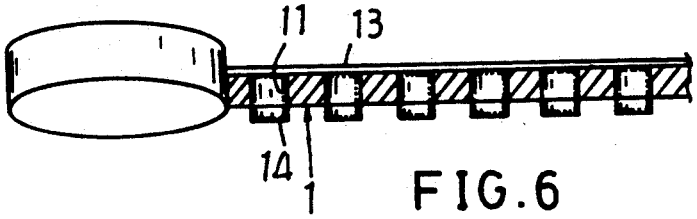
FIG. 6 shows still another preferred embodiment of the present invention.
Figure 4:
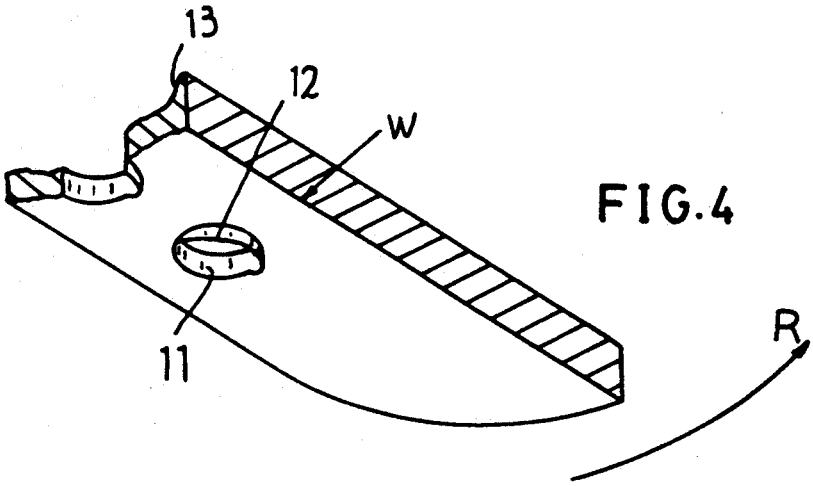
FIG. 4 is an illustration showing a partial fan blade of the present invention when rotated.
Figure 7:
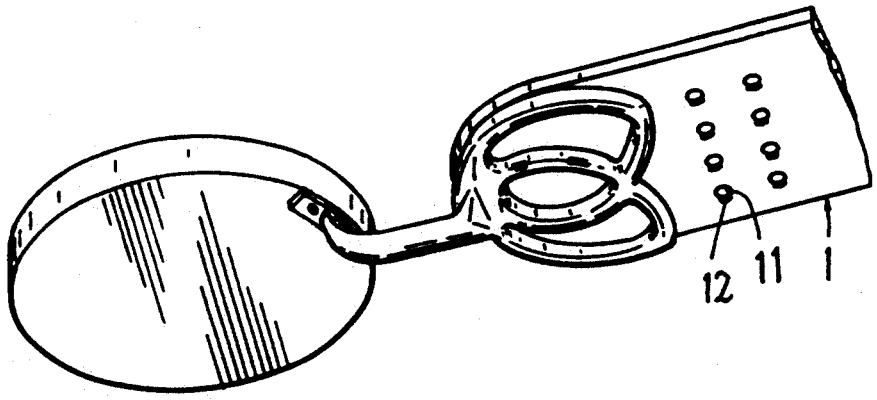
FIG. 7 is a perspective view of a fan blade of the present invention.

As shown in FIG. 6, each perforation 11 of the fan blade 1 may be embedded with a cell 14 filled with liquid to absorb frictional heat during the rotation of the fan blade 1.

Accordingly, the present invention may provide an air fan with lighter fan blades for reducing the weight of fan blades and for reducing the force driven by the fan motor for saving electric energy. Also, the material for making the fan blade may also be saved for saving production cost of the fan.

I claim:

1. An air fan comprising a plurality of fan blades each said fan blade formed with a plurality of perforations in each said blade for reducing weight of said blade, having a noise-preventive extension circumferentially formed on the fan blade around a circumferential edge of each said perforation for precluding an air stream flowing through each said perforation for preventing a whistling noise therefrom.

2. An air fan according to claim 1, wherein said noise-preventive extension preferably occupies at least one third of a perimeter along a perforation circle of each said perforation.

3. An air fan according to claim 1, wherein said noise-preventive extension is provided on a windward side of each said perforation facing towards an incoming wind direction when rotating the fan blade in a direction opposite to the incoming wind direction.

* * * * *